US006755072B1

(12) United States Patent
Kanemitsu et al.

(10) Patent No.: US 6,755,072 B1
(45) Date of Patent: Jun. 29, 2004

(54) BALL-BATTING IMPLEMENT TESTING DEVICE

(75) Inventors: Yumi Kanemitsu, Hyogo (JP); Jun Nishibayashi, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/069,875

(22) PCT Filed: Sep. 1, 1999

(86) PCT No.: PCT/JP99/04730

§ 371 (c)(1),
(2), (4) Date: Mar. 1, 2002

(87) PCT Pub. No.: WO01/15782

PCT Pub. Date: Mar. 8, 2001

(51) Int. Cl.[7] ..... G01M 19/00
(52) U.S. Cl. ..... 73/11.01
(58) Field of Search ..... 73/11.01, 12.14, 73/12.12, 13; 273/29 A, 26 R; 473/423

(56) References Cited

U.S. PATENT DOCUMENTS

| | | | | | |
|---|---|---|---|---|---|
| 3,855,842 | A | * | 12/1974 | Imabori et al. | 73/13 |
| 4,049,266 | A | * | 9/1977 | Feiler | 273/29 A |
| 4,062,222 | A | * | 12/1977 | Solheim | 73/13 |
| 4,886,267 | A | * | 12/1989 | Licciardi et al. | 273/26 R |
| 4,938,478 | A | * | 7/1990 | Lay | 273/26 R |
| 4,996,867 | A | * | 3/1991 | Miyamae | 73/13 |
| 5,755,645 | A | * | 5/1998 | Miller et al. | 482/115 |
| 5,908,979 | A | * | 6/1999 | Miyamae | 73/12.14 |

FOREIGN PATENT DOCUMENTS

| | | |
|---|---|---|
| JP | 59-38968 U | 3/1984 |
| JP | 9-149958 A | 6/1997 |
| JP | 9-239687 A | 9/1997 |
| JP | 11-44614 A | 2/1999 |

OTHER PUBLICATIONS

Journal [No. 940–9] of the Japanese Society of Mechanical Engineers, Symposium on AVD Lecture Papers, p. 128 and the English translation of any relevant parts thereof.
Journal [No. 95–28] of the Japan Society of Mechanical Engineers, fourth meeting Symposium on Motion and Vibration Control Lecture Papers, p. 170 and the English translation of any relevant parts thereof.
Journal [95–17] of the Japan Society of Mechanical Engineers, Robotics and Mechatronics lecture, 1995 Lecture Papers (vol. B), p. 1260 and the English translation of any relevant parts thereof.
Journal [No. 96–20] of the Japan Society of Mechanical Engineers, Symposium Lecture Papers, p. 35 and the English translation of any relevant parts thereof.
Nikkei Mechanical, May 15, 1995, No. 454, p. 66 and the English translation of any relevant parts thereof.

* cited by examiner

*Primary Examiner*—Edward Lefkowitz
*Assistant Examiner*—Octavia Davis
(74) *Attorney, Agent, or Firm*—Birch, Stewart, Kolasch & Birch, LLP

(57) ABSTRACT

A testing equipment including a first joint extending upright from a base (11), a final joint on which a holder (24) for holding a grip of a ball-hitting tool is installed, and an intermediate joint disposed between the first and final joints. The first, intermediate, and final joints are successively connected to each other and rotated by individual driving devices in such a way that the ball-hitting tool held by the holder installed on the final joint is swung in X, Y-, and Z-directions or/and rotated around a longitudinal axis of the ball-hitting tool held by the holder to adjust/increase or decrease a distance, between a ball-hitting plane and the base, corresponding to a motion of a person swinging his/her arm up and down, with the person gripping the ball-hitting tool, adjust/change an angle of the ball-hitting plane corresponding to an inward rotation of the arm or an outward rotation thereof, and/or adjust/change an angle between a longitudinal axis of the ball-hitting tool and the base.

5 Claims, 12 Drawing Sheets

BALL-BATTING IMPLEMENT TESTING DEVICE

This application is the national phase under 35 U.S.C. §371 of PCT International Application No. PCT/JP99/04730 which has, an International filing date of Sep. 1, 1999, which designated the United States of America.

TECHNICAL FIELD

The present invention relates to a ball hitting tool testing device and more specifically to a testing device applicable to a ball-hitting tool such as a racket for tennis, badminton, squash, table tennis, a golf club, and a bat for baseball. In particular, the present invention relates to a testing device, which is preferably used for the tennis racket. With a robot gripping the tennis racket, the testing equipment device performs several motions of the tennis racket which is performed at the time of stroke by a person with the person gripping the tennis racket. Thereby the testing device allows quantitative evaluation of speed of the a ball at the time of a stroke, controllability, and spin performance.

BACKGROUND ART

Research has been made for a testing device of a ball-hitting tool such as the tennis racket so that the testing device has a function of hitting a ball in a state close to that in which a person actually hits the ball.

For example, the conventional testing device of the tennis racket is disclosed in the following books: Journal [No. 940-9] of the Japan Society of Mechanical Engineers, Symposium on AVD Lecture Papers, Page 128; Journal [No. 95-28] of the Japan Society of Mechanical Engineers, fourth meeting Symposium on Motion and Vibration Control Lecture Papers, Page 170; [No. 95-17] Journal of the Japan Society of Mechanical Engineers, Robotics and Mechatronics lecture, 1995 Lecture Papers (Vol.B), Page 1260; Journal [No.96-20] of the Japan Society of Mechanical Engineers, Symposium Lecture Papers, Page 35; and Nikkei Mechanical, May 15, 1995, No.454, Page 66.

The testing device of the tennis racket reported in the above-described books has a construction shown in FIG. 10. The testing equipment is designed by considering that when a person performs a ball-hitting motion, with the human gripping the tennis racket, the tennis racket makes a complicated motion which is a combination of a translation motion and a rotary motion. The testing equipment is a horizontal two-joint robot having a minimum necessary degree of freedom to allow the translation motion and the rotary motion to be accomplished.

That is, in the testing device, the motor 1 rotates (rotation on S-axis) the first joint 2 directly in a direction shown with an arrow, the first joint 2 is connected to one end of the connection plate 3, the second joint 4 is rotatably installed on the other end of the connection plate 3, the first joint 2 and the second joint 4 are interlocked with each other with the timing belt 5, and the motor 1 rotates (rotation on T-axis) the second joint 4 in a direction shown with an arrow. The holder 6 is fixed to the second joint 4, and the grip 8*a* of the tennis racket 8 is inserted into and fixed to the holder 6.

The testing device having the horizontal two joints is driven by one driving device (motor 1). The rotation of the first joint 2 (corresponding to person's shoulder) on the S-axis and the rotation of the second joint 4 (corresponding to person's wrist) on the T-axis are synchronous with each other. The testing device can reproduce a ball-hitting motion of the tennis racket at a volley time in playing tennis.

As shown in FIGS. 11 and 12, the holder 6 has the shock-absorbing rubber sheet 2 disposed on the inner peripheral surface of each of the fixing parts 1*a* and 1*b* each made by dividing a metal cylinder into halves. With the grip 21*a* of the tennis racket 20 sandwiched between the fixing parts 1*a* and 1*b* through the rubber sheet 2, the fixing parts 1*a* and 1*b* are clamped with the screw 3 to hold the tennis racket 10 thereby.

The testing device having two horizontal joints has been developed to measure the mechanical characteristic of the tennis racket at the time of a volley in playing tennis. Thus the tennis robot is capable of evaluating the performance of the tennis racket only at the time of the volley but is incapable of evaluating the performance of the tennis racket at the time of a stroke. In evaluating the performance of the tennis racket, the evaluation of speed of a ball, controllability, and spin performance at the time of the stroke are more important than the evaluation of the tennis racket at the time of the volley. As described above, since the conventional testing device has the horizontal two joints, it has a problem in that it is incapable of evaluating the performance of the tennis racket at the time of the stroke.

More specifically, a swing in tennis is made not in one swing plane but is varied because a player raises his/her body and lifts his/her arm. To spin a ball when the ball is served, it is necessary to angularly change the racket plane by inward rotating the arm. An effective volley can be made not only by hitting the ball with the racket plane vertical to the ground but also in combination of an angle change of the longitudinal axis of the racket to the ground by a vertical swing motion of the wrist and the outward rotation of the arm.

The testing, having two horizontal joints, shown in FIG. 10 is incapable of reproducing several motions including a rotation-accompanied vertical motion of the tennis racket following a motion of the upper part of a player's body, a rotating motion of the tennis racket by a twist of the wrist caused by inward and outward rotation of the arm and a vertical motion of the wrist.

The collision speed of the tennis racket held by the testing device is as low as about 5 m/sec. Although description is made in the above-described books that the collision speed of the tennis racket held by the testing equipment is as high as 30 m/sec, the description is not substantiated.

The head speed of the tennis racket at the time of the stroke is 10–30 m/sec in regulation-ball tennis and 50 m/sec in softball tennis. The head speed of the tennis racket swung by a high-class player is faster by about 10 m/sec than that of the tennis racket swung by a beginner. The angular velocity of the high-class player's wrist is faster by 700°/sec than that of the beginner's wrist (page 70 through 77 of "New Science of Tennis" published by tennis journal).

The most conspicuous difference in players' swings is a swing speed and in particular the difference between swing speeds of wrists. Thus there is a demand that the testing equipment is capable of adjusting the head speed of the tennis racket in the range of 5–50 m/sec. However, as described above, since the collision speed in the testing equipment device is about 5 m/sec, the testing equipment is incapable of realizing a high head speed.

Depending on the high-class player and the beginner, the testing device is required to allow the rotation speed of the entire testing equipment and the rotation speed around the wrist to be freely adjusted. However, in the testing device shown in FIG. 10, since one motor drives the first joint and the second joint, the testing device is incapable of freely adjusting the rotation speed (rotation speed of the first joint) of the entire testing device and the rotation speed (rotation speed of the second joint) around the wrist independently and freely.

Further the holder 6, made of metal and rubber, used in the testing device shown in FIG. 10 is incapable of absorbing a shock and a strain applied to the holder 6 as a result of a collision between the tennis racket and the ball at the time of a high-speed swing. Thus in the case where the testing device conducts a ball-hitting test repeatedly, the tennis racket is broken at the shaft or the throat thereof.

SUMMARY OF THE INVENTION

The present invention has been made in view of the above-described problem. It is a first object of the present invention to provide a testing device, of a ball-hitting tool such as a tennis racket, which reproduces a motion of a tennis racket at the time of a stroke. It is a second object of the present invention to provide a testing device, which can adjust a ball collision speed from a low speed to a high speed and adjust a rotation-speed thereof and a rotation speed of a wrist independently. It is a third object of the present invention to provide a testing device whose racket-holding part can hold a ball-hitting tool in a state similar to a state in which a person grips the ball-hitting tool.

DISCLOSURE OF THE INVENTION

To solve the above-described problem, there is provided a testing device including a first joint extending upright from a base, a final joint on which a holder for holding a grip of a ball-hitting tool is installed, an intermediate joint disposed between the first and final joints. The first, intermediate, and final joints are successively connected to each other and rotated by individual driving devices in such a way that the ball-hitting tool held by the holder installed on the final joint is swung in X-, Y-, and Z-directions or/and rotated around a longitudinal axis of the baIl-hitting tool held by the holder to adjust/increase or decrease a distance, between a ball-hitting plane and the base, corresponding to a motion of a person swinging his/her arm up and down, with the person gripping the ball-hitting tool, adjust/change an angle of the ball-hitting plane corresponding to an inward rotation of the arm or an outward rotation thereof, and/or adjust/change an angle between a longitudinal axis of the ball-hitting tool and the base.

More specifically, the intermediate joint connected to the first and final joints having a swinging head respectively for swinging a body includes a lower arm joint (L-axis) connected to an upper end of the first joint (S1-axis) and swinging in a front-to-back direction; an upper arm joint (U-axis) connected to the lower arm joint (L-axis) and swinging in a vertical direction; a wrist joint (R-axis) connected to the upper arm joint (U-axis) and rotating on a longitudinal axis thereof; a wrist-swinging-joint (B-axis) connected to one end of the wrist joint (R-axis) and rotating in a vertical direction; and a wrist-rotation-joint (T1-axis) connected to the wrist-swinging joint (B-axis) and swinging in a left-to-right direction.

Further, a wrist-speed-increase-rotation-joint (T2-axis) swinging horizontally is provided on the wrist-rotation-joint (T1-axis) as the final joint; an extension plate is installed on the final joint; and the holder for holding the ball-hitting tool consisting of a tennis racket is held on one end of the extension plate (claim 2).

Let it be supposed that the ball-hitting tool testing device having the above-described construction is used as a testing equipment for a tennis racket. In this case, the testing equipment has the rotation shaft which rotates in a vertical direction, the rotation shaft corresponding to an inward rotation and outward rotation of a person's arm, and the rotation shaft that can change the angle of the longitudinal axis of the tennis racket to the ground. Thus the testing device can reproduce a several ball-hitting motion including a spin-giving motion in a stroke or a serve and a volley similar to that in an actual play.

Further since the joints are driven by separate driving devices (motors), the rotation speeds of the joints can be adjusted separately. Thus it is possible to reproduce the characteristics of swings different from each other depending on a player. It is also possible to adjust the rotation speed of the entire testing device and the rotation speed of the joint corresponding to a player's wrist independently. Therefore, it is possible to adjust the ball collision speed and the angular velocity of the wrist independently and freely.

The holder for holding the ball-hitting tool is fixed to a free end of an extension plate mounted on the final joint. Thereby it is possible to allow the rotation radius of the ball-hitting tool held by the holder and the head speed of the ball-hitting tool to be high.

Since the intermediate joints rotate simultaneously in the X-direction, the Y-direction, and the Z-direction, it is possible to reproduce an operation corresponding to a swing-up motion and a swing-down motion of an arm holding the ball-hitting tool. The operation is performed by adjusting/increasing or decreasing the distance between the ball-hitting plane and the base (ground). It is necessary for the ball-hitting tool testing equipment to perform an operation (swing) in such a way that a swing-up angle or a swing-down angle, namely, a straight line connecting a swing start point and a swing finish point to each other forms an angle of in the range of −10°~+10° to the ground. Favorably in the range of −40°~+40°. More favorably in the range of −70°~+70°.

Further since the ball-hitting tool testing device has a function of rotating the ball-hitting tool, with the longitudinal direction thereof set as the axis of rotation, a function corresponding to inward and outward rotation of a player's arm can be reproduced. This operation can be performed by adjusting/varying an angle of the ball-hitting plane. The angle range of the ball-hitting plane can be adjusted/varied favorably in the range of −30°~+30° and more favorably in the range of −45°~+45°.

The ball-hitting tool testing device also has a function of altering an angle between the axis of the ball-hitting tool in its longitudinal direction and the base (ground). It is favorable to adjust/vary the angle in the range of −10°~+10°. It is more favorable to adjust/vary the angle $\alpha$ in the range of −45°~+135°. It is most favorable to adjust/vary the angle $\alpha$ in the range of −55°~+215°.

The intermediate joint is rotatably installed on an upper portion of the first joint and includes a speed increase joint (S2-axis) that is rotated by a rotation driving device separate from that of the first joint, and the head speed of the ball-hitting tool held by the final joint can be adjusted in the range of 5 m/sec–50 m/sec. Therefore the testing device is capable of coping with the head speed at the time when a high-class player hits a ball as well as to a head speed at the time when a beginner hits the ball.

Further the holder installed on the final joint includes an elastic sheet disposed along an inner peripheral surface of a cylindrical portion consisting of a rigid body in such way that the elastic sheet contains an air layer inward therefrom to allow the elastic sheet to grip the ball-hitting tool inserted into a bore of the cylindrical portion by injecting air into the air layer and inflating the elastic sheet; and a force for holding the holder is set to a range of 0.5–5 kgf/cm$^2$.

The reason the force for holding the holder is set to the range of 0.5–5 kgf/cm$^2$ is as follows: If the force is less than 0.5 kgf/cm$^2$, the tennis racket cannot be gripped firmly. On the other hand, if the force is more than 5 kgf/cm$^2$, an abnormal strain is generated on the tennis racket because the force exceeds a pressure at which a person grips the tennis racket.

More specifically, the elastic sheet disposed along the inner peripheral surface of the cylindrical portion in such way that the elastic sheet contains the air layer inward therefrom consists of an elastic tube having a hollow peripheral wall bonded to the inner peripheral surface of the cylindrical portion. An air injection path is formed on a peripheral wall of the cylindrical portion and a peripheral wall of the elastic tube in such a way that the air injection path penetrates through the peripheral wall of the cylindrical portion and the peripheral wall of the elastic tube. A check valve is provided inside the air injection path to seal air injected into the elastic tube.

The elastic tube is inserted into the bore of the cylindrical portion and an extra portion of the elastic tube projecting from an opening at the upper and lower ends of the cylindrical portion is folded. The folded portion is fixed to the peripheral surface of the cylindrical portion. Thereby it is possible to obtain the elastic sheet disposed along the inner peripheral surface of the cylindrical portion in such way that the elastic sheet contains the air layer inward therefrom. The air injection path communicating with the gap between the inner peripheral surface of the cylindrical portion and the elastic tube is formed on the peripheral surface of the cylindrical portion. The check valve is provided inside the air injection path to seal air injected into the gap from outside.

In the holder, since the ball-hitting tool is gripped with the elastic sheet (elastic tube) inflated with an air pressure. Thus the ball-hitting tool-gripping state is similar to the state in which a person grips it with her/his hand. That is, because the ball-hitting tool is gripped with the elastic force of the elastic sheet and the air pressure, the elastic sheet deforms greatly when a ball collides with the ball-hitting tool gripped in this way. Thereby the gripped ball-batting implement moves greatly. Therefore when the ball is hit with a tennis racket gripped in this way, it is possible to effectively lessen an impact force generated when the ball is hit and eliminate a disadvantage that a strain concentrates on the shaft and throat of the tennis racket.

BEST MODE FOR CARRYING OUT THE INVENTION

Figure 1:
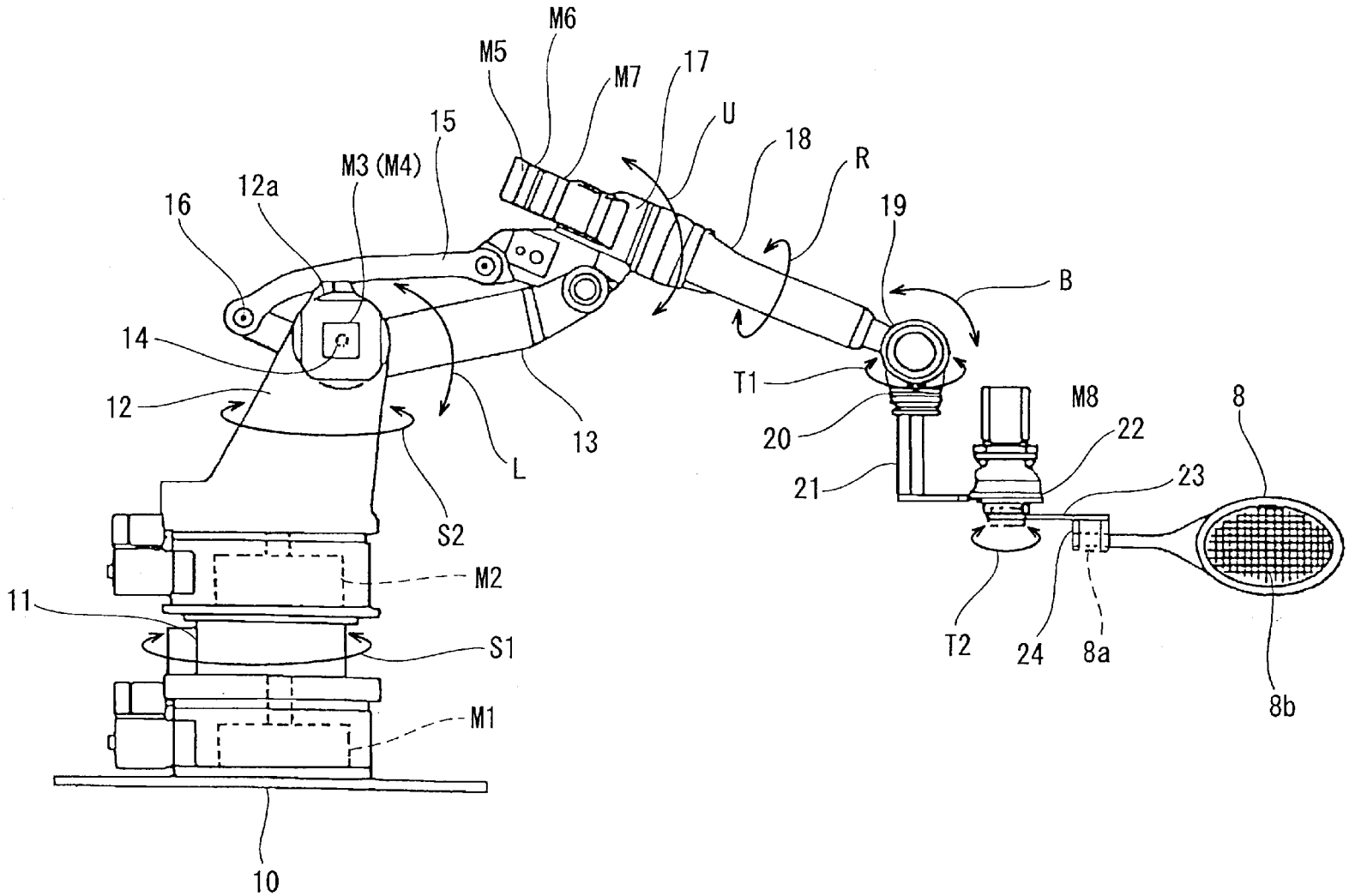
FIG. 1 is a front view showing a testing equipment of a first embodiment of the present invention.

The embodiments of the present invention will be described below with reference to drawings.

A testing device of a first embodiment shown in FIGS 1 through 8 is used for a tennis racket. A first joint 11 (S1-axis) having a swinging head is erected over a base 10. A second joint 12 (S2-axis) consisting of a speed increase swinging head is mounted over the first joint 11. A third joint 13 serving as a lower arm joint (L-axis) is rotatably connected to one end of an upward projection portion 12*a* of the second joint 12 through a shaft 14. A link 15 is rotatably connected to one end of the third joint 13 through a shaft 16. One end of the link 15 and one end of the third joint 13 are connected to a fourth joint 17 (U-axis) serving as a upper arm joint.

A base of a fifth joint 18 (R-axis) serving as a wrist rotation joint is rotatably connected to one end of the fourth joint 17. One portion of a peripheral surface of a sixth joint (B-axis) 19 serving as a wrist-swinging joint is fixed to one end of the fifth joint 18. A seventh joint (T1-axis) 20 serving as a wrist rotation joint is fixed to the other portion of the peripheral surface of the sixth joint 19.

An L-shaped connection plate 21 is fixed to one end of the seventh joint 20. An eighth joint (T2-axis) 22 serving as a wrist speed increase rotation joint is connected to one end of the connection plate 21. An extension plate 23 made of a metal plate (aluminum or the like) is fixed to one end of the eighth joint 22. A holder 24 holding a grip 8*a* of a tennis racket 8 is fixed to one end of the extension plate 23.

The first joint 11, the eighth joint 22 which is the final joint, and the second joint 12 through the seventh joint 20, which are intermediate joints, sequentially connected to each other between the first joint 11 and the eighth joint 22 are driven by independent motors. That is, motors M1 and M2 are accommodated inside housings accommodating a rotation shaft of the swinging head of each of the first joint (S1-axis) 11 and the second joint (S2-axis) 12 respectively. The swinging head of each of the first joint 11 and the second joint 12 pivots in the same rotation direction of an X-direction (left-to-right direction). The third joint (L-axis) 13 is pivoted in a Y-direction (front-to-back direction) direction shown with an arrow L in FIG. 1 by a motor M3 installed on a shaft-installing portion. The fourth joint (U-axis) 17 is pivoted in a Z-direction (vertical direction) direction shown with an arrow U by a motor M4 installed-on a rear side of the shaft-installing portion opposed to the motor M3. The fifth joint (R-axis) 18, the sixth joint (B-axis) 19, and the seventh joint (T1-axis) 20 are rotated in an x-direction, a y-direction, and a z-direction respectively shown with arrows R, B, and T1 by motors M5, M6, and M7 mounted on the base side of the fourth joint 17. A motor M8 for the eighth joint (T2-axis) 22 that is the final joint is mounted on the connection plate 21. One end of the extension plate 23 is fixed to an output shaft of the motor M8.

By driving the first joint through the eighth joint by the independent motors Ml through M8, the rotational speed of each joint can be adjusted independently and arbitrarily.

Figure 2:
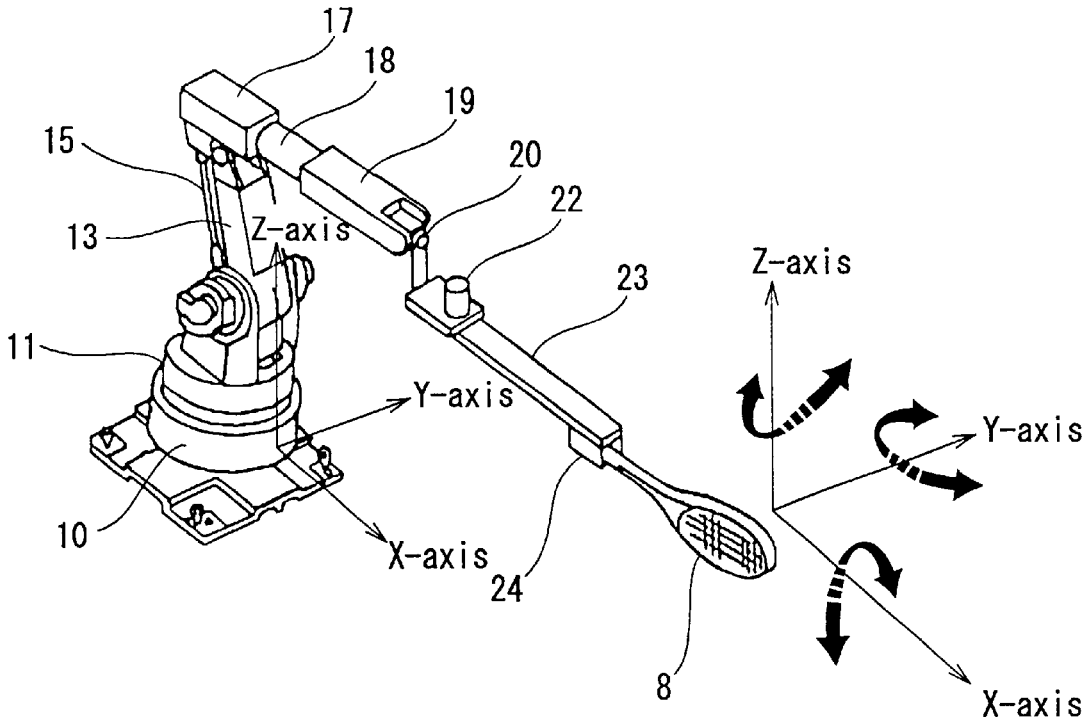
FIG. 2 is a perspective view showing an operation direction of the testing equipment.
Figure 3:
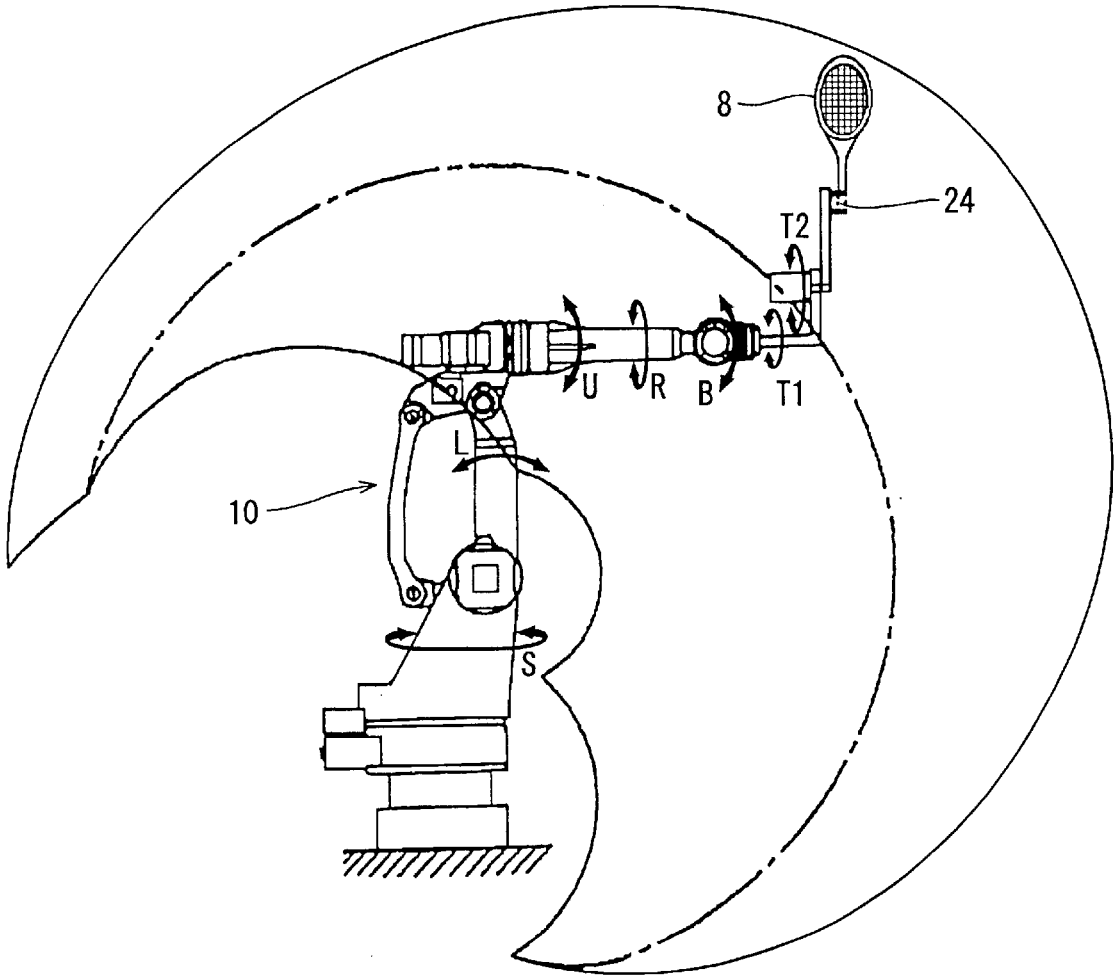
FIG. 3 shows an operation region of the testing device.

The holder 24 installed on the one end of the eighth joint 22 which is the final joint operates in a wide region of the X-direction, the Y-direction, and the Z-direction by simultaneous rotating motion of the first joint through the eighth joint in the x-axis direction, the y-axis direction, and the Z-axis direction, as shown in FIGS. 2 and 3. In particular, a dimension L1 (300 mm in the embodiment) between the seventh joint 20 and the eighth joint 22 is offset, and the holder 24 is installed at the one end of the extension plate 23 spaced at a dimension L2 (360 mm in the embodiment) from the eighth joint 22. Therefore the rotation radius (shown with a solid line in FIG. 3) of the tennis racket 8 held by the holder 24 is large and thus the head speed of the tennis racket 8 can be made high. The region shown with a one-dot chain line in FIG. 3 indicates the rotation region of the ball-hitting tool in the case where the holder 24 is installed on the seventh joint 20.

As described above, with the tennis racket 8 held by the holder 24, a body of the testing equipment including the first joint, the second joint, the third joint, and the fourth joint are rotated in the X-axis direction, the Y-axis direction, and the Z-axis direction, and the fifth joint, the sixth joint, the seventh joint, and the eighth joint constituting a wrist are rotated in the x-axis direction, the y-axis direction, and the z-axis direction. Thus the tennis racket 8 can accomplish the motions listed below.

Figure 4:
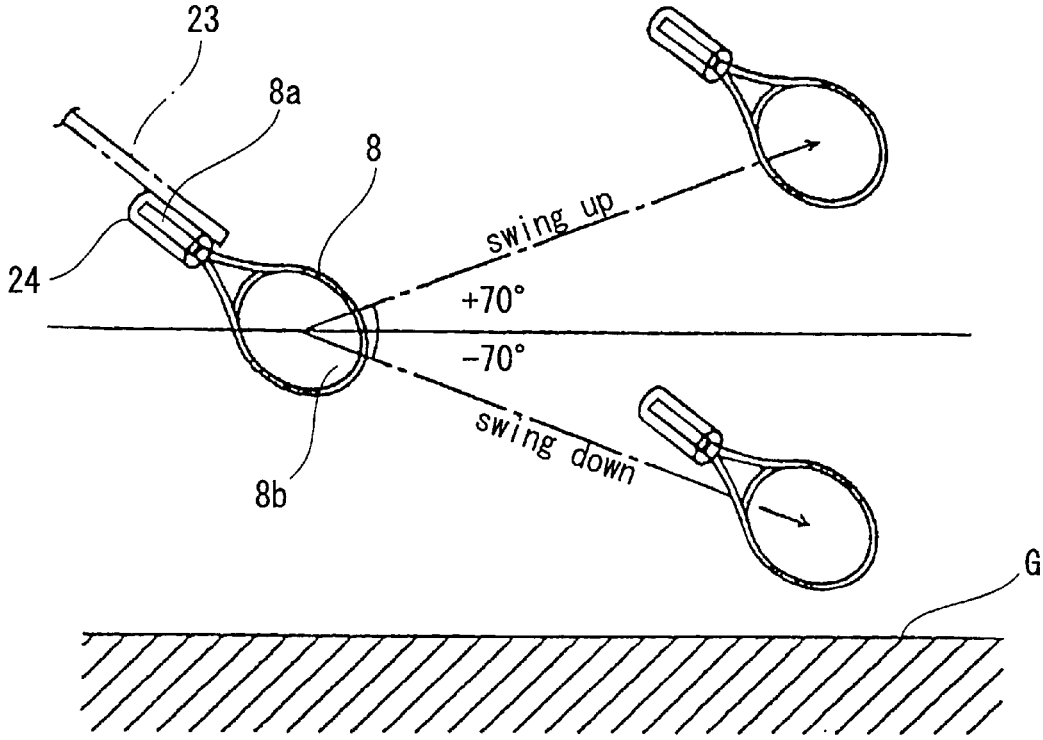
FIG. 4 shows an example of a motion of a tennis racket performed by the testing equipment.

That is, as shown in FIG. 4, the ball-hitting tool testing device has a function of adjusting the distance between the tennis racket 8 and the ground G and is capable of adjusting the height of a ball-hitting plane 8*b* of the tennis racket 8 easily. The ball-hitting tool testing device is also capable of increasing (tennis racket is swung up) and decreasing (tennis racket is swung down) the distance between the tennis racket 8 and the ground (base) G. As described above, the ball-hitting tool testing device allows the tennis racket to swing in such a way that a straight line connecting a swing start point and a swing finish point to each other has a certain angle to the ground G. This operation is performed by the rotation of the third joint 13 (L-axis), the fourth joint 17 (U-axis), and the fifth joint 18 (B-axis). It is necessary for the ball-hitting tool testing device to perform an operation (swing) in such a way that the straight line connecting the swing start point and the swing finish point to each other forms an angle of in the range of −10°~+10° to the ground G. Favorably in the range of −40°~+40°. More favorably in the range of −70°~+70°.

Figure 5:
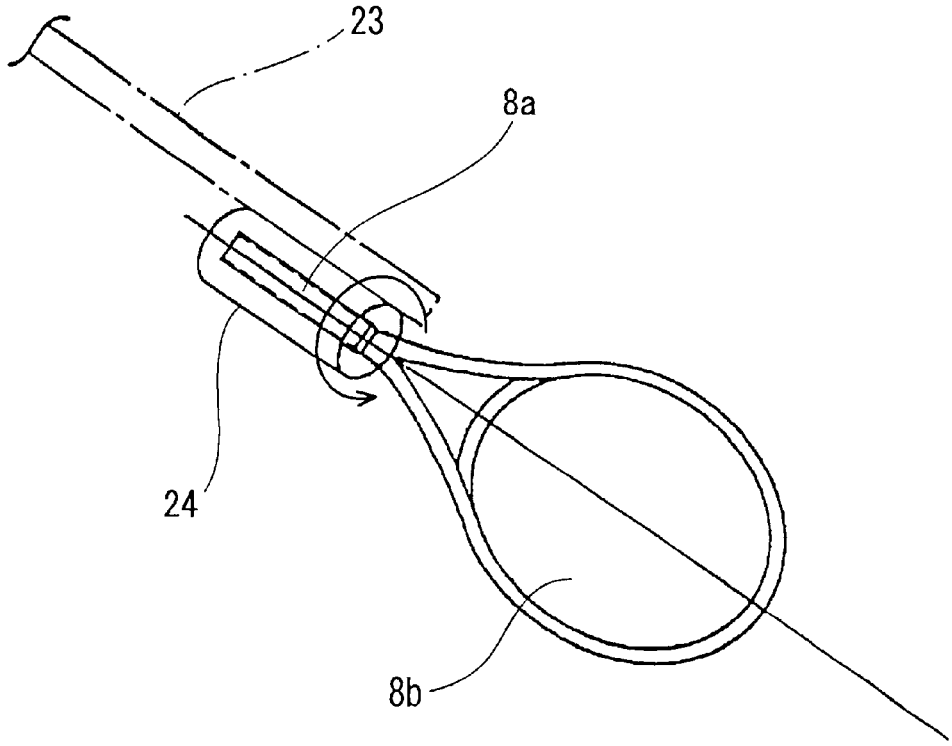
FIG. 5 shows an example of a motion of a tennis racket performed by the testing equipment.

Further as shown in FIG. 5, the ball-hitting tool testing device has a function of rotating the tennis racket 8, with the longitudinal direction thereof set as the axis of rotation, namely, a function corresponding to inward and outward rotations of a player's arm. Thus the ball-hitting tool testing device allows the angle of the ball-hitting plane 8*b* of the tennis racket 8 to be adjusted/varied. The angle range of the ball-hitting plane 8*b* of the tennis racket 8 can be adjusted/varied favorably in the range of −30°~+30° and more favorably in the range of −45°~+45°.

The above-described rotation can be accomplished at the time of a swung. In this case, it is possible to reproduce spinning of a ball when the ball is hit with the tennis racket 8. This motion is performed by adjusting the rotation of the fourth joint 17 (R-axis).

Figure 6A:
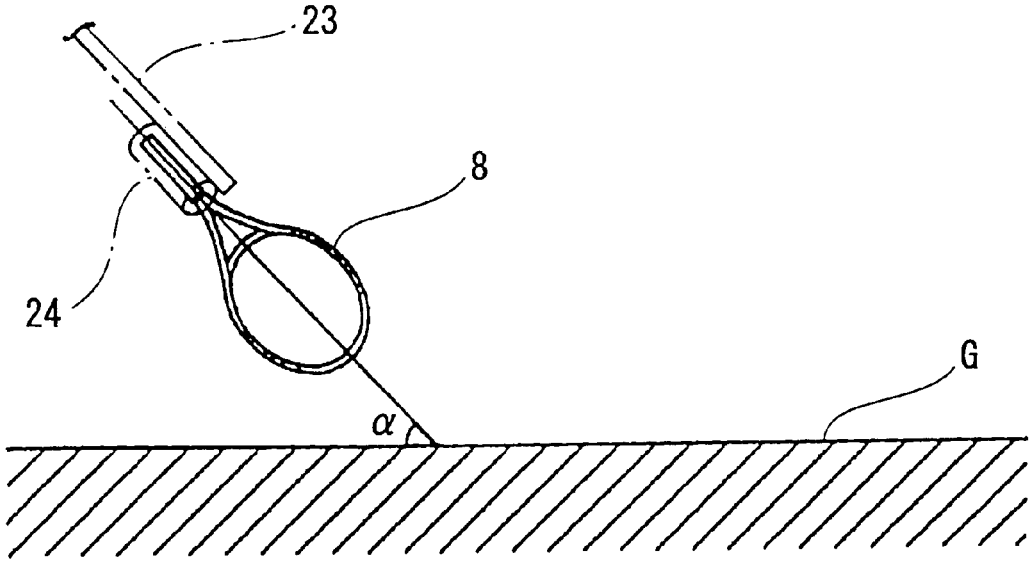
FIG. 6 shows an example of a motion of a tennis racket performed by the testing equipment.
Figure 6B:
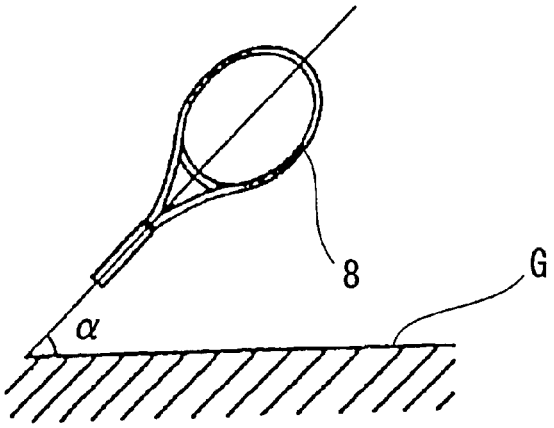

As shown in FIG. 6, the ball-hitting tool testing equipment also has a function of altering an angle α between the axis of the tennis racket 8 in its longitudinal direction and the ground G. It is possible to alter the angle α during swinging. This operation can be performed by the rotation of the third joint 13 (L-axis), the fourth joint 17 (U-axis), and the sixth joint 19 (B-axis). It is favorable to adjust/vary the angle α in the range of −10°~+10°. It is more favorable to adjust/vary the angle α in the range of −45°~+135°. It is most favorable to adjust/vary the angle α in the range of −55°~+215°.

By forming the swinging head for turning the body of the ball-hitting tool testing equipment in the horizontal X-direction on the first joint 11 and the speed increase second joint 12 and by rotating the swinging head by the separate motors Ml and M2, it is possible to make the rotation of the tennis racket 8 during swing thereof high. Thereby the head speed of the tennis racket 8 held by the final joint can be adjusted in a wide range of 5 m/sec~50 m/sec.

Figure 7:
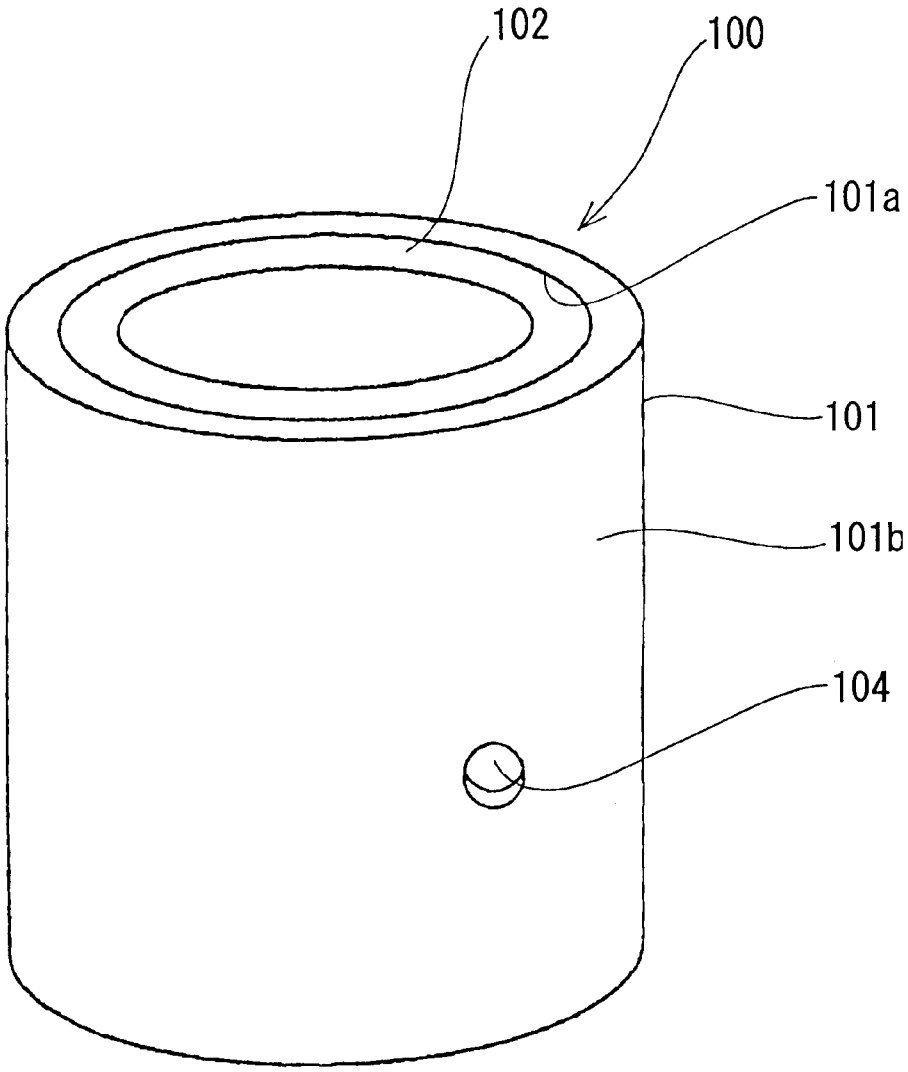
FIG. 7 is a perspective view showing a holder mounted on the testing equipment.
Figure 8:
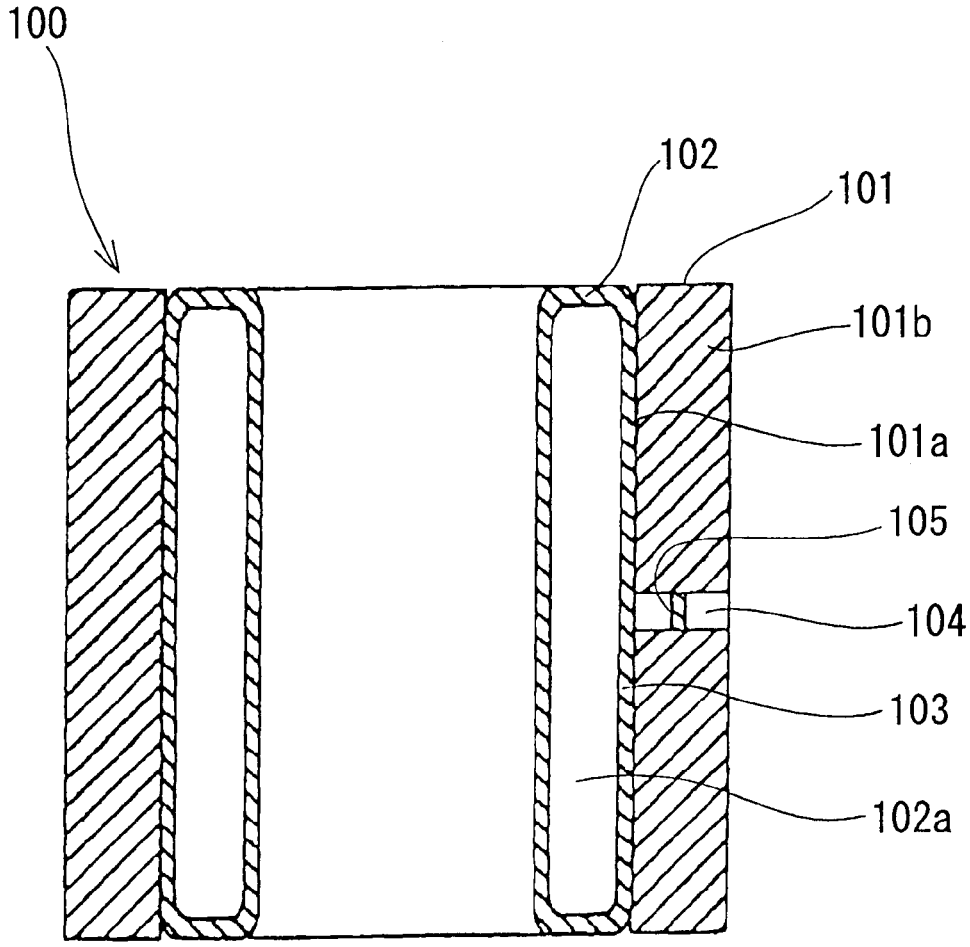
FIG. 8 is a sectional view showing the holder.

The holder 24 has a construction shown in FIGS. 7 and 8. In the holder 24, a peripheral surface of an annular rubber tube 102 having a height almost equal to that of an aluminum cylinder 101, a peripheral length almost equal to an inner peripheral length of the aluminum cylinder 101, and a hollow peripheral wall, and consisting of styrene-butadiene rubber (SBR) is bonded to an inner peripheral surface 101*a* of the aluminum cylinder 101 having an axial length of 70 mm and an inner diameter of 70 mm. The elastic modulus of the rubber tube is $5\times10^7$ dyn/cm$^2$, and its thickness is 2.5 mm. An air injection path 104 having a diameter of 4 mm is formed on a peripheral wall 101*b* of the aluminum cylinder 101 and the peripheral wall 103 of the rubber tube 102 bonded to the inner peripheral surface 101*a* of the cylinder 101 of the rubber tube 102 in such a way that the air injection path 104 penetrates through the peripheral wall 101*b* and the peripheral wall 103. Air is injected into a hollow portion 102*a* of the rubber tube 102 from outside through the air injection path 104. To seal the air injected into the hollow portion 102*a* of the rubber tube 102, a check valve 105 is provided inside the air injection path 104. The air pressure inside the hollow portion 102*a* of the rubber tube 102 is adjusted by an injection amount of air injected thereinto from outside. The holder 24 is fixed to the one end of the extension plate 23 with a bolt or the like.

In the work of the holder 24 of gripping the grip 8*a* of the tennis racket 8, initially, the grip 8*a* of the tennis racket 8 is inserted into a bore of the aluminum cylinder 101 of the holder 24. Thereafter an unshown air pump feeds air into the hollow portion 102*a* of the rubber tube 102 through the air injection path 104 in such a way that the hollow portion 102*a* has a desired air pressure to inflate the rubber tube 102. Thereby the grip portion 8*a* of the tennis racket 8 is compressed by the inner peripheral surface of the rubber tube 102 to hold the grip 8*a* of the tennis racket 8.

In the case where the holder 24 is used, a strain applied to the tennis racket at the time of hitting a ball is very similar to that applied thereto when a person hits the ball with the person gripping the tennis racket, unlike the case where the person uses the conventional holder. That is, similarly to the case where the person hits the ball, with the person gripping the tennis racket, a big strain is not applied to the throat and shaft of the tennis racket. Further a strain applied to the tennis racket damps periodically, similarly to the case where the person hits the ball with the person gripping the tennis racket.

The present invention is not limited to the above-described embodiment, but it is possible to change the distance L1 between the seventh joint 20 and the eighth joint 22 and the distance L2 between the eighth joint 22 and the holder 24. For example, in a modification of the first embodiment, the distance L1 is set to 300 m equal to that in the first embodiment, and the distance L2 is set to 1200 mm.

Figure 9:
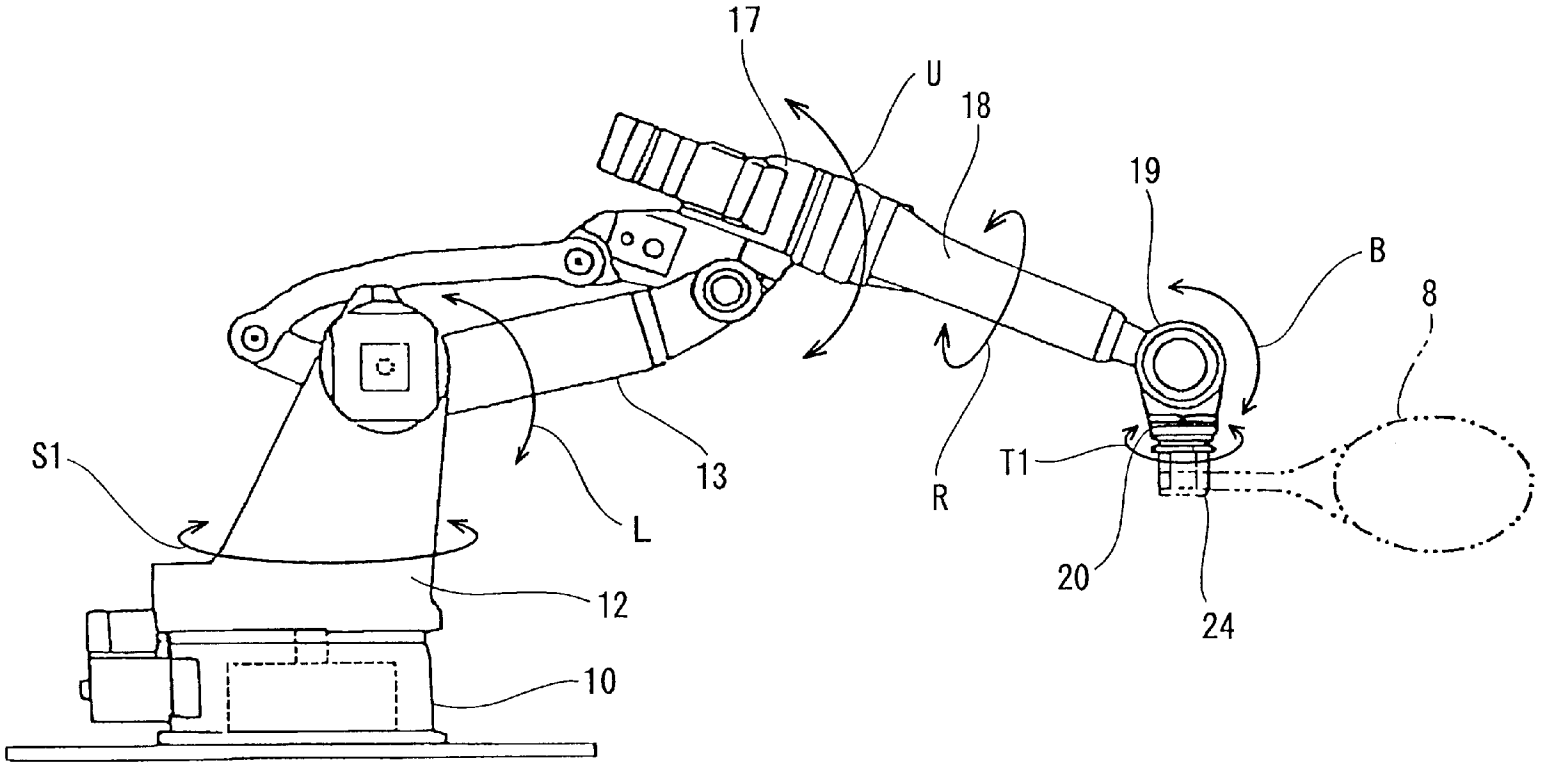
FIG. 9 is a front view showing a second embodiment of the present invention.
Figure 10:
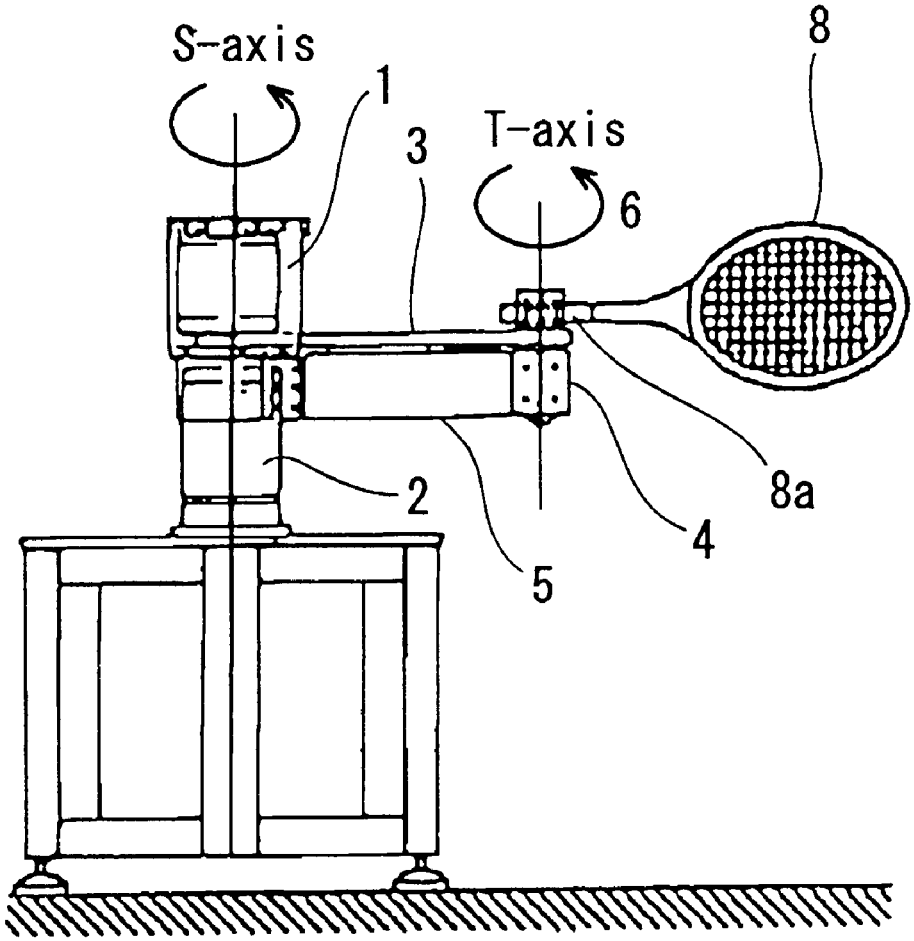
FIG. 10 is a front view showing a conventional testing equipment.
Figure 11:
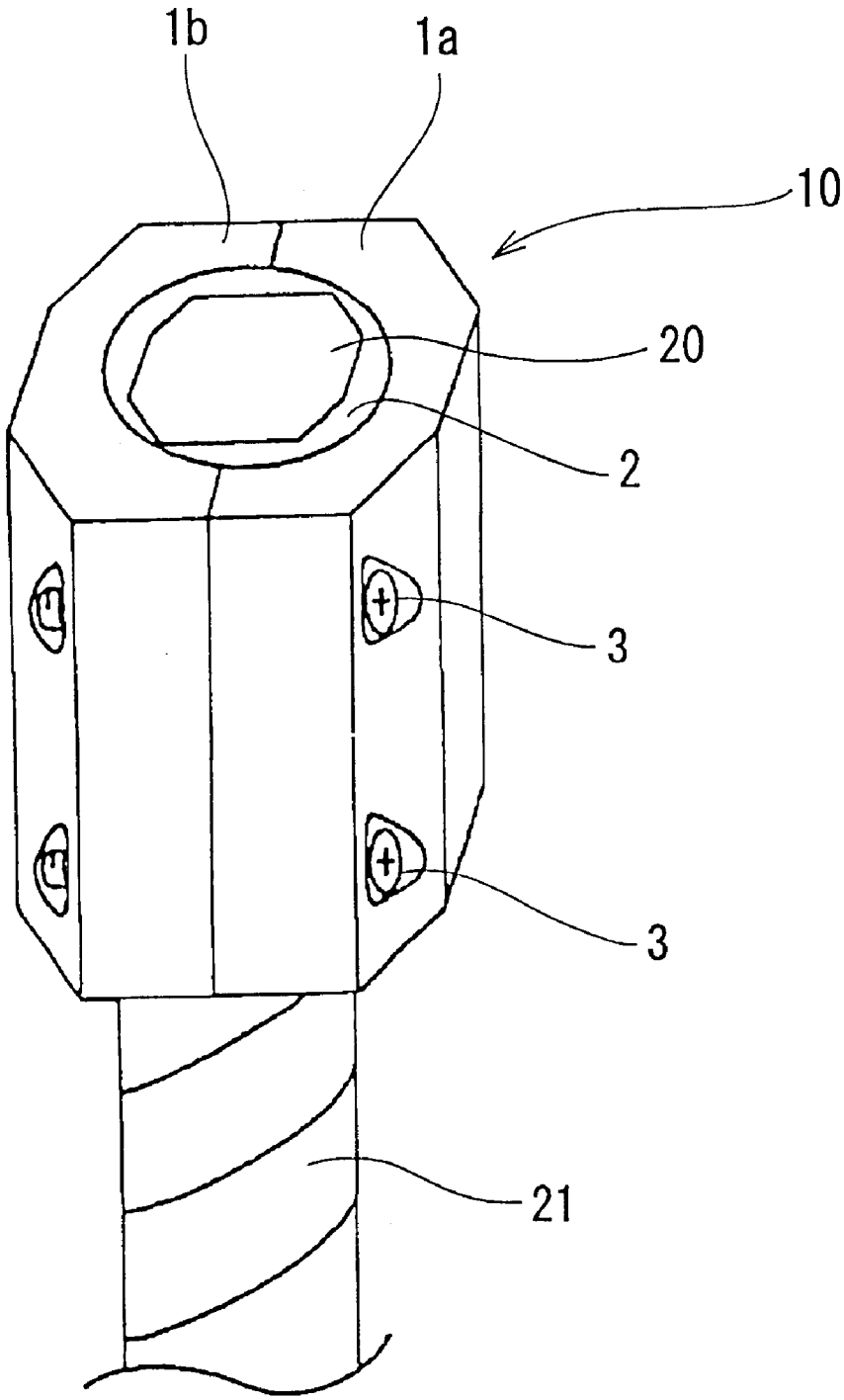
FIG. 11 is a perspective view showing a tennis racket holder of the conventional tennis racket testing equipment.
Figure 12:
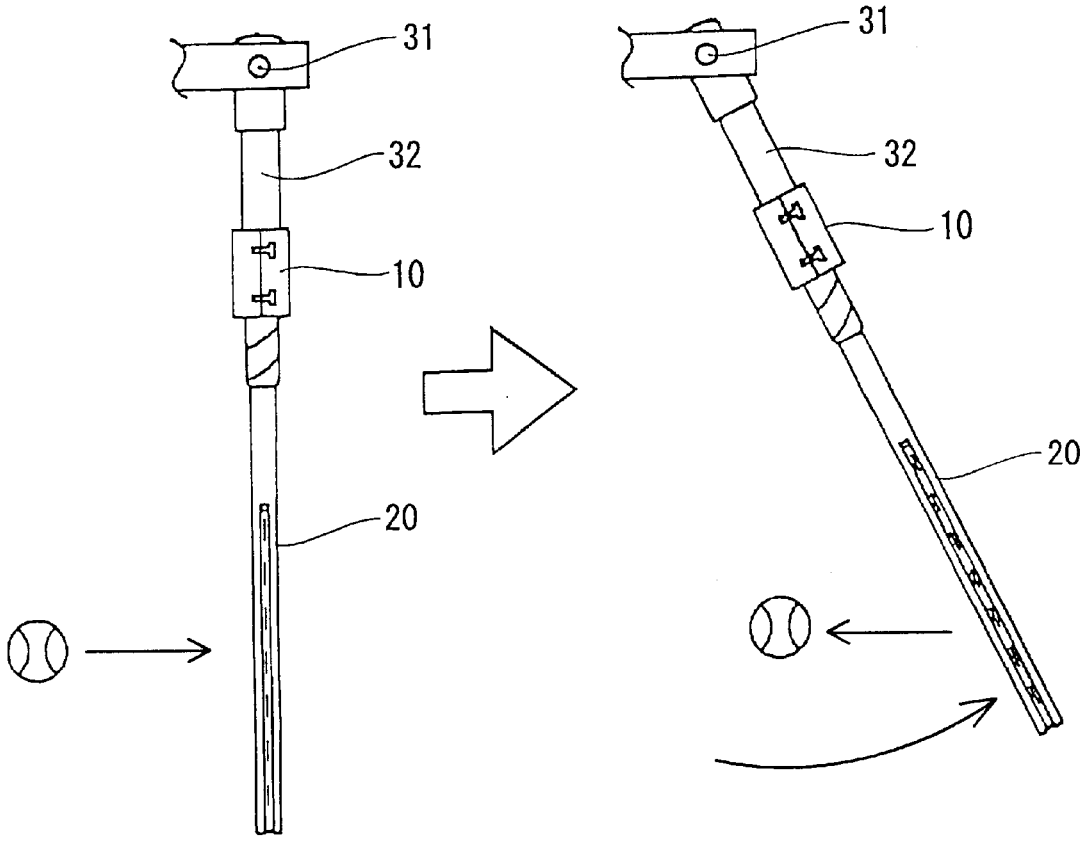
FIG. 12 is a side view showing an example of the testing equipment using the holder shown in FIG. 11.

FIG. 9 shows a second embodiment. The ball-hitting tool testing device has one swinging head. The holder 24 is directly fixed to a lower portion of the seventh joint 20, and the holder 24 holds the tennis racket 8. That is, the second joint (S2-axis) and the eighth joint (T1-axis) are eliminated. Thereby the testing device has six joints.

EXAMPLE

A hitting test was conducted by installing a tennis racket on the holder 24 of the testing equipment of the first embodiment (experiment 1), the modification of the first embodiment (experiment 2), and the second embodiment (experiment 3) to measure the maximum head speed of the tennis racket, the rotation speed of the body (first joint~fourth joint), the rotation speed of the grip, and the swing-up angle of the tennis racket. The head speed of the tennis racket was calculated based on a period of time it took for the tennis racket to pass between lasers spaced at 100 mm. To indicate the swing-up angle, the difference in the position of the head of the racket between the start time of a swing and the finish time thereof is indicated by an angle to the ground. The angle of the racket plane is a decanted angle of the racket plane to the position set to 0° at which the grip 8*a* is gripped in such a way that the ball-hitting plane 8*b* is vertical to the ground. The angle of the longitudinal axis of the tennis racket is an angle of the longitudinal axis thereof to the ground.

In the experiment 1, the S1-axis of the first joint and the S2-axis of the second joint were rotated at 300°/sec, and the T1-axis of the seventh joint and the T2-axis of the eighth joint were rotated at 680°/sec. The experiment 2 was conducted identically to the experiment 1. In the experiment 3, the S1-axis was rotated at 150°/sec, and the T1-axis was rotated at 340°/sec.

The results of the hitting test are shown in table 1 below.

TABLE 1

| | Experiment 1 | Experiment 2 | Experiment 3 |
|---|---|---|---|
| Maximum head speed (m/sec) of racket | 28 | 49 | 10 |
| Rotation speed (degree/sec) of body | S1-axis and S2-axis can be independently set less than 300 | Same as experiment 1 | S1-axis can be set at less than 150 |
| Rotation speed (degree/sec) of grip | T1-axis and T2-axis can be independently set less than 680 | Same as experiment 1 | T1-axis can be set at less than 340 |
| Swing-up angle of racket | ±70° | Same as experiment 1 | ±70° |
| Other items | Angle of the racket plane ±350° Up to 240°/S Angle of longitudinal axis −55°~+215° Maximum 240°/S Speed can be set independently | Same as experiment 1 | Same as experiment 1 |

As shown in table 1, the head speed of the tennis racket was obtained up to 28 m/sec in the experiment 1, and the head speed of the tennis racket was obtained up to 49 m/sec in the experiment 2. The head speed of the tennis racket was obtained up to 10 m/sec in the experiment 3. It could be confirmed that in the case where the eighth joint was added, the extension plate was provided, and the tennis racket was held by the holder fixed to the one end of the extension plate, the head speed could be made higher. It was also confirmed that the rotation speed of the body (lower arm, upper arm) of the testing equipment and the rotation speed of the wrist holding the grip of the tennis racket could be adjusted independently and that the swing-up motion and the swing-down motion could be reproduced.

Although the testing device of the above-described embodiments are applied to the tennis racket, it is possible to use the testing equipment for other ball-hitting tools such as a racket for badminton, squash, table tennis, a golf club, a bat for baseball by holding them by the holder.

INDUSTRIAL APPLICABILITY

As apparent from the foregoing description, according to the ball-hitting tool testing device of the present invention, includes a plurality of joints driven by separate driving devices. The ball-hitting tool is held by the holder installed on the final joint. Thus the ball-hitting tool can be operated simultaneously in the X-direction, the Y-direction, and the Z-direction, and further rotated on the longitudinal axis thereof. That is, it is possible to adjust/increase or decrease the distance, between the ball-hitting plane and the base, corresponding to a motion of a person swinging his/her arm up and down, with the person gripping the ball-hitting tool, adjust/change the angle of the ball-hitting plane corresponding to an inward rotation of the arm or an outward rotation thereof, or/and adjust/change the angle between the longitudinal axis of the ball-hitting tool and the base.

Consequently the testing device can reproduce not only a volley performed by the conventional testing device but also a hitting operation at the time of a stroke. Further the testing equipment can reproduce not only flat hitting but also spin-giving at the time of a stroke. Further since it is possible to change the angle of the ball-hitting plane of the tennis racket and the angle of the longitudinal axis of the tennis racket, it is possible to reproduce the spin-giving at the time of a volley and a serve. Thus the testing device can reproduce a motion close to a player's behavior.

Furthermore since the joints are driven by separate driving devices (motors), it is possible to realize a complicated behavior. That is, the swing speed of the body (arm) of the testing equipment and the swing speed of the wrist can be independently adjusted. Thus the testing equipment is capable of coping with a high-class player as well as a beginner. Further the head speed of the tennis racket at the time of a stroke can be adjusted in a range of 5 m/sec–50 m/sec. Thus the testing device is capable of coping with the head speed of the high-class player as well as the beginner in regulation-ball tennis and softball tennis.

Further according to the holder installed on the testing device of the present invention, by inflating a bag consisting of a rubber sheet and gripping the ball-hitting tool by the elastic force of rubber and an air pressure, the holder can hold the ball-hitting tool in a state close to a state in which a person grips the ball-hitting tool. Therefore the testing equipment allows realization of a state very similar to the state in which the person actually hits a ball. Thus owing to the use of the testing equipment, it is possible to measure the characteristics of the ball-hitting tool such as impact-absorbing performance and durability in a state in which the ball-hitting tool is actually used by the person.

What is claimed is:

1. A testing device comprising: a first joint extending upright from a base, a final joint on which a holder for holding a grip of a ball-hitting tool is installed, and an intermediate joint disposed between said first and final joints, wherein said first, intermediate, and final joints are successively connected to each other and rotated by individual driving motors in such a way that said ball-hitting tool held by said holder installed on said final joint is swung in any of perpendicular X-, Y-, and Z-directions; rotated around a longitudinal axis of said ball-hitting tool held by said holder in order to adjust, increase or decrease a distance between a ball-hitting plane and said base, corresponding to a motion of a person swinging his or her arm up and down with said person gripping said ball-hitting tool; swung so as to adjust or change an angle between said ball-hitting plane and said base, corresponding to an inward rotation of said arm or an outward rotation thereof; and swung so as to adjust or change an angle between a longitudinal axis of said ball-hitting tool and said base, wherein said intermediate joint connected to said first and final joints having a swing device for swinging a body includes a lower arm joint (L-axis) connected to an upper end of said first joint (S1-axis) and swinging in a front-to-back direction; an upper arm joint (U-axis) connected to said lower arm joint (L-axis) and swinging in a vertical direction; a wrist joint (R-axis) connected to said upper arm joint (U-axis) and rotating on a longitudinal axis thereof; a wrist-swinging joint (B-axis) connected to one end of said wrist joint (R-axis) and rotating in a vertical direction; and a wrist rotation joint (T1-axis) connected to said wrist-swinging joint (B-axis) and swinging in a left-to-right direction, and wherein a wrist-speed-up-rotation-joint (T2-axis) horizontally swinging is provided on said wrist rotation joint as said final joint; an extension plate is installed on said final joint; and said holder for holding said ball-hitting tool consisting of a tennis racket is held on one end of said extension plate.

2. A testing device comprising: a first joint extending upright from a base, a final joint on which a holder for holding a grip of a ball-hitting tool is installed, and an intermediate joint disposed between said first and final joints, wherein said first, intermediate, and final joints are successively connected to each other and rotated by individual driving motors in such a way that said ball-hitting tool held by said holder installed on said final joint is swung in any of perpendicular X-, Y-, and Z-directions; rotated around a longitudinal axis of said ball-hitting tool held by said holder in order to adjust, increase or decrease a distance between a ball-hitting plane and said base, corresponding to a motion of a person swinging his or her arm up and down with said person gripping said ball-hitting tool; and swung so as to adjust or change an angle between said ball-hitting plane and said base, wherein said intermediate joint is rotatably installed on an upper portion of said first joint and includes a speed up joint (S2-axis) that is rotated by a driving device separate from that of said first joint; and a head speed of said ball-hitting tool held by said final joint can be adjusted in a range of 5 m/sec–50 m/sec.

3. The ball-hitting tool testing equipment according to claim 1 or 2, wherein said holder installed on said final joint includes an elastic sheet disposed along an inner peripheral surface of a cylindrical portion consisting of a rigid body in such way that said elastic sheet contains an air layer inward therefrom to allow said elastic sheet to grip said ball-hitting tool inserted into a bore of said cylindrical portion by injecting air into said air layer and inflating said elastic sheet; and a force for holding said holder is set to a range of 0.5–5 kgf/cm$^2$.

4. The ball-hitting tool testing device according to claim 1 or 2, wherein said ball-batting tool consists of a racket for tennis, badminton, squash, table tennis, a golf club or a bat for baseball.

5. The ball-hitting tool testing equipment according to claim 3, wherein said ball-batting implement consists of a racket for tennis, badminton, squash, table tennis, a golf club or a bat for baseball.

* * * * *